US010096195B2

(12) United States Patent
Niizuma

(10) Patent No.: US 10,096,195 B2
(45) Date of Patent: Oct. 9, 2018

(54) MONEY PROCESSING DEVICE

(71) Applicant: FUJI ELECTRIC CO., LTD., Kawasaki-shi, Kanagawa (JP)

(72) Inventor: Nobuyuki Niizuma, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/657,765

(22) Filed: Jul. 24, 2017

(65) Prior Publication Data

US 2018/0047239 A1 Feb. 15, 2018

(30) Foreign Application Priority Data

Aug. 10, 2016 (JP) ..... 2016-157855

(51) Int. Cl.
*G07F 9/10* (2006.01)
*G07D 11/00* (2006.01)

(52) U.S. Cl.
CPC ..... *G07D 11/0084* (2013.01); *G07D 11/0018* (2013.01); *G07D 11/0021* (2013.01); *G07F 9/10* (2013.01)

(58) Field of Classification Search
CPC .. G07F 3/00; G07F 9/10; G07F 19/00; G07D 3/00; G07D 9/00; G07D 9/008; G07D 11/0003; G07D 11/0057; G07D 11/0081; G07D 13/00; B65H 2701/1912
See application file for complete search history.

(56) References Cited

U.S. PATENT DOCUMENTS

2002/0014736 A1* 2/2002 Katou ..... B65H 1/025 271/126
2009/0184034 A1* 7/2009 Doi ..... G06Q 20/10 209/534

FOREIGN PATENT DOCUMENTS

JP 2015-225614 A 12/2015

* cited by examiner

*Primary Examiner* — Mark J Beauchaine
(74) *Attorney, Agent, or Firm* — Manabu Kanesaka

(57) ABSTRACT

A money processing device includes: an operation unit including a money input port through which money is input and a money output port through which money is discharged; a money processing unit provided on a rear side of the operation unit, and configured to: take in money input through the money input port so as to sort the input money and store the sorted money in a storage space; and convey money corresponding to change from the storage space to the operation unit so as to output the corresponding money through the money output port when a money output instruction is given; and a replenishing and collecting unit provided on a rear side of the money processing unit, and configured to: replenish money of the money processing unit; and collect the money stored in the storage space into a collection space when a collection command is given.

7 Claims, 10 Drawing Sheets

MONEY PROCESSING DEVICE

CROSS-REFERENCE TO RELATED APPLICATION(S)

The present application claims priority to and incorporates by reference the entire contents of Japanese Patent Application No. 2016-157855 filed in Japan on Aug. 10, 2016.

BACKGROUND

1. Technical Field

The disclosure relates to a money processing device. More specifically, the disclosure relates to a money processing device used as a change machine, for example.

2. Related Art

Recently, a money processing device serving as an automatic change machine has been installed in stores such as a supermarket and a convenience store to handle customers and to provide stricter cash management. Typically, the money processing device is connected to a host device such as a point of sales (POS) register device to configure a register system, and is used for performing processing of inputting or outputting money such as a coin and a bill in response to a command from the host device.

Such a money processing device includes an operation unit and a money processing unit. The operation unit is a part for giving and receiving money that includes a money input port through which money is input and a money output port through which money is discharged. The money processing unit takes in money input through the money input port so as to sort the input money and store the sorted money in a storage space, and conveys money corresponding to change from the storage space to the operation unit so as to output the corresponding money through the money output port when a money output instruction is given. The operation unit of such a money processing device is typically facing a salesperson of a store as an operator, and money replenishing work, money collecting work, or maintenance work such as releasing jamming of money is performed on the operation unit side (for example, refer to Japanese Laid-open Patent Publication No. 2015-225614).

SUMMARY

In recent years, to improve efficiency of store operation, a self-checkout machine and a semi-self-checkout machine have rapidly spread for stores and the like. The self-checkout machine is used such that a customer himself/herself registers a commodity to be purchased, and gives and receives money. The semi-self-checkout machine is used such that a salesperson registers a commodity to be purchased, and a customer only gives and receives money.

When the money processing device described above is applied to a register system such as a self-checkout machine and a semi-self-checkout machine, the operation unit is installed facing a customer.

Thus, when performing work such as collecting work and maintenance work on the money processing device of the self-checkout machine or the semi-self-checkout machine, a worker needs to perform such work from a customer side, so that other persons in the store such as the customer can see money, which is undesirable from the viewpoint of crime prevention.

It is an object of the disclosure to at least partially solve the problems in the conventional technology.

In some embodiments, a money processing device includes: an operation unit including a money input port through which money is input and a money output port through which money is discharged, and serving as a part for giving and receiving money; a money processing unit provided on a rear side of the operation unit, and configured to: take in money input through the money input port so as to sort the input money and store the sorted money in a storage space; and convey money corresponding to change from the storage space to the operation unit so as to output the corresponding money through the money output port when a money output instruction is given; and a replenishing and collecting unit provided on a rear side of the money processing unit, and configured to: replenish money of the money processing unit; and collect the money stored in the storage space into a collection space when a collection command is given.

In some embodiments, a money processing device includes: an operation unit including a money input port through which money is input and a money output port through which money is discharged, and serving as a part for giving and receiving money; a money processing unit provided on a rear side of the operation unit, and configured to: take in money input through the money input port so as to sort the input money and store the sorted money in a storage space; and convey money corresponding to change from the storage space to the operation unit so as to output the corresponding money through the money output port when a money output instruction is given; and a main body having a rectangular parallelepiped shape where each of front and rear surfaces has an opening, the main body being configured to house the money processing unit therein. When a pull-out operation is performed on the money processing unit, the main body is configured to allow the money processing unit to be pulled out only through the opening of the rear surface.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

The following describes preferred embodiments of a money processing device according to the disclosure in detail with reference to the attached drawings.

First Embodiment

Figure 1:
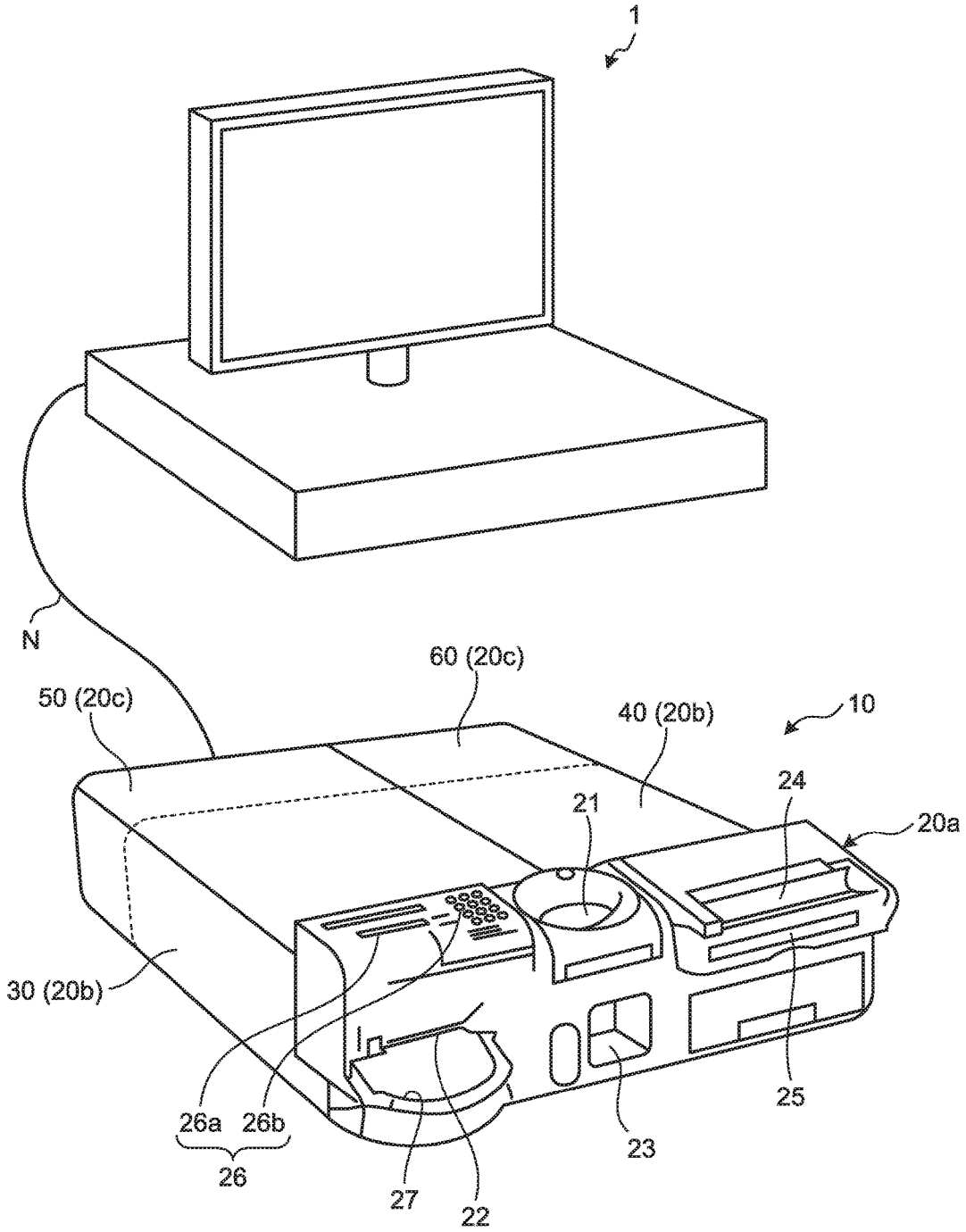
FIG. 1 is a perspective view illustrating a register system to which a money processing device according to a first embodiment of the disclosure is applied.

FIG. 1 is a perspective view illustrating a register system to which a money processing device according to a first embodiment of the disclosure is applied. The register system exemplified herein is used in stores such as a supermarket and a convenience store, and includes a money processing device 10 used as an automatic change machine.

The money processing device 10 is connected to a POS register device 1, which is a host device, via a communication line N, and includes an operation unit 20*a*, a money processing unit 20*b*, and a replenishing and collecting unit 20*c*.

The operation unit 20*a* configures a front portion of the money processing device 10, and includes a coin input port 21, a coin output port 22, a coin return port 23, a bill input port 24, a bill output port 25, and an operation display part 26.

The coin input port 21 is an opening through which a coin is input. The coin output port 22 is an opening through which a coin is discharged to a tray 27 on the outside. The coin return port 23 is an opening through which a coin is returned. The bill input port 24 is an opening through which a bill is input. The bill output port 25 is an opening through which a bill is discharged to the outside.

The operation display part 26 includes a display part 26*a* and an operation part 26*b*. The display part 26*a* is a part that displays various pieces of information such as reception states of money for each denomination. The operation part 26*b* is used by an operator for inputting various commands, and includes a plurality of push button switches, for example.

The money processing unit 20*b* is arranged on the rear side of the operation unit 20*a*, and includes a coin processing unit 30 and a bill processing unit 40.

Figure 2:
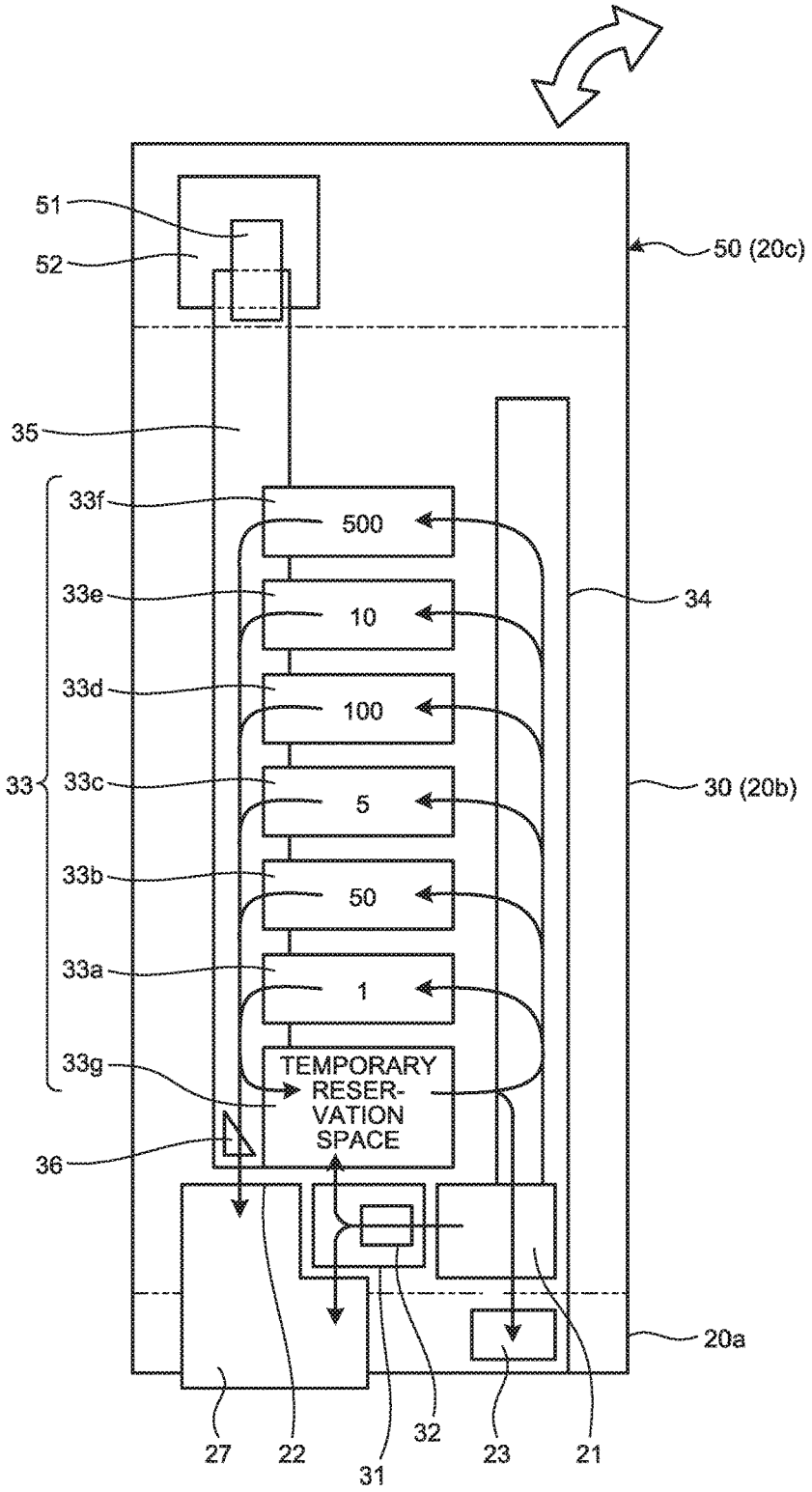
FIG. 2 is a schematic diagram schematically illustrating an internal structure of a principal part of the money processing device illustrated in FIG. 1 when viewed from above.
Figure 3:
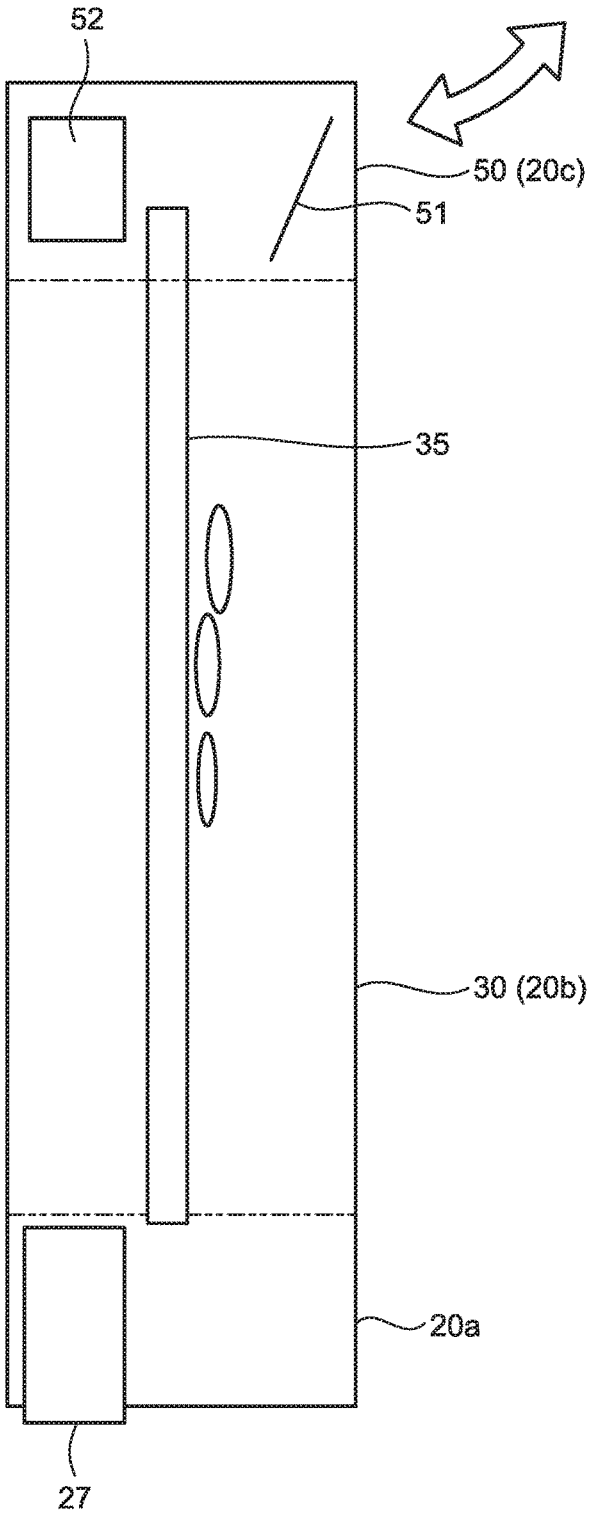
FIG. 3 is a schematic diagram schematically illustrating the internal structure of the principal part of the money processing device illustrated in FIG. 1 when viewed from a side.

As illustrated in FIGS. 2 and 3, the coin processing unit 30 is arranged at the rear of the coin input port 21, the coin output port 22, and the coin return port 23, and includes an input money conveying mechanism 31, a coin identification sensor 32, a coin storage space 33, a sorting and conveying mechanism 34, and an output money conveying mechanism 35.

The input money conveying mechanism 31 conveys a coin input through the coin input port 21. The coin identification sensor 32 determines whether the coin conveyed by the input money conveying mechanism 31 is true or false, and determines a denomination thereof.

The coin storage space 33 includes a one-yen coin storage space 33*a*, a fifty-yen coin storage space 33*b*, a five-yen coin storage space 33*c*, a hundred-yen coin storage space 33*d*, a ten-yen coin storage space 33*e*, and a five-hundred-yen coin storage space 33*f* that are arranged for each denomination to store coins of a corresponding denomination, and includes a temporary reservation space 33*g* for temporarily reserving a coin.

The sorting and conveying mechanism 34 conveys a coin reserved in the temporary reservation space 33*g*. To convey the coin forward, the sorting and conveying mechanism 34 conveys the coin reserved in the temporary reservation space 33*g* to the coin return port 23. To convey the coin backward, the sorting and conveying mechanism 34 conveys the coin reserved in the temporary reservation space 33*g* to the coin storage space 33*a* or the like.

The output money conveying mechanism 35 conveys the coin forward or backward. When an output money sorting gate 36 is switched to the temporary reservation space 33*g* side, the output money conveying mechanism 35 conveys the coin to be conveyed to the temporary reservation space 33*g*. When the output money sorting gate 36 is switched to the coin output port 22 side, the output money conveying mechanism 35 conveys the coin to be conveyed to the coin output port 22.

Figure 4:
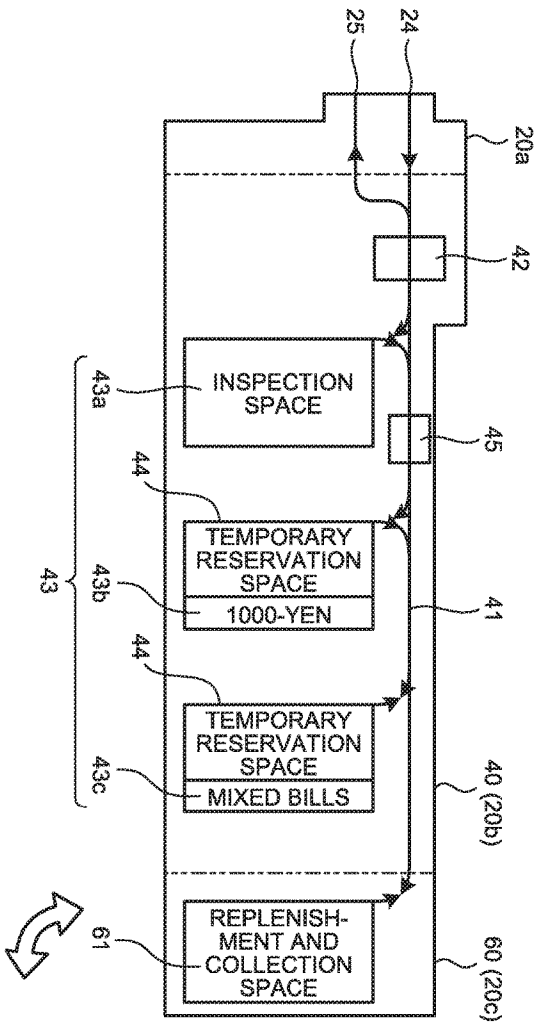
FIG. 4 is a schematic diagram schematically illustrating the internal structure of the principal part of the money processing device illustrated in FIG. 1 when viewed from a side.

As illustrated in FIG. 4, the bill processing unit 40 includes a bill conveying mechanism 41, a bill discrimination sensor 42, and a bill storage space 43.

The bill conveying mechanism 41 conveys a bill. The bill discrimination sensor 42 determines whether a bill conveyed by the bill conveying mechanism 41, more specifically, the bill that is input through the bill input port 24 and conveyed by the bill conveying mechanism 41 is true or false, and determines the denomination thereof.

The bill storage space 43 includes an inspection space 43*a*, a one-thousand-yen bill storage space 43*b*, and a mixed bills storage space 43*c*. The inspection space 43*a* is a storage space for temporarily storing bills when the one-thousand-yen bill storage space 43*b* and the mixed bills storage space 43*c* are temporarily emptied of bills stored therein to recalculate the number of bills stored in each bill storage space 43. The one-thousand-yen bill storage space 43*b* is a space for storing a one-thousand-yen bill. A temporary reservation space 44 is dividedly configured on an upstream side portion of the one-thousand-yen bill storage space 43*b*. The mixed bills storage space 43*c* is a space for storing bills other than the one-thousand-yen bill. The temporary reservation space 44 is dividedly configured on an upstream side portion of the mixed bills storage space 43*c*.

The replenishing and collecting unit 20*c* is arranged on the rear side of the money processing unit 20*b*, and includes a coin replenishing and collecting unit 50 and a bill replenishing and collecting unit 60.

As illustrated in FIGS. 2 and 3, the coin replenishing and collecting unit 50 is arranged on the rear side of the coin processing unit 30, and includes a coin replenishing part 51 and a coin collection space 52. The coin replenishing part 51 is driven when a replenishment command is given, and replenishes a coin of the coin processing unit 30. For example, the coin replenishing part 51 is configured with a conveying mechanism such as a conveyance belt.

The coin collection space 52 is a space for collecting a coin stored in the coin storage space 33*a* or the like when a collection command is given and the output money conveying mechanism 35 is driven backward. The coin replenishing and collecting unit 50 is arranged on the coin processing unit 30 in a detachable manner. Although not illustrated in the drawings, the coin replenishing and collecting unit 50 includes a door body to be opened or closed when a coin is replenished or collected.

As illustrated in FIG. 4, the bill replenishing and collecting unit 60 is arranged on the rear side of the bill processing unit 40, and includes a replenishment and collection space 61. When a bill replenishment command is given, the replenishment and collection space 61 sends out a bill to be stored to the bill conveying mechanism 41. On the other hand, when a bill collection command is given, the replenishment and collection space 61 stores and collects a bill conveyed by the bill conveying mechanism 41. The bill replenishing and collecting unit 60 is arranged on the bill processing unit 40 in a detachable manner. Although not illustrated in the drawings, the bill replenishing and collecting unit 60 includes a door body to be opened or closed when a bill is replenished or collected.

The following simply describes an operation (a coin input operation, a coin output operation, a coin replenishment operation, a coin collection operation, a bill input operation, a bill output operation, a bill replenishment operation, and a bill collection operation) of the money processing device 10 having the configuration described above.

Coin Input Operation

When a coin is input through the coin input port 21 by a transaction, the coin input port 21 temporarily reserves a deposit from a customer. The coin that is temporarily reserved as described above is detected by an input detection sensor (not illustrated) in response to a money input permission command from the POS register device 1, and conveyed to the input money conveying mechanism 31. The coin identification sensor 32 determines whether the coin conveyed by the input money conveying mechanism 31 is true or false, and determines the denomination thereof. The coin that is determined to be a true coin by the coin identification sensor 32 is reserved in the temporary reservation space 33*g*. On the other hand, the coin that is determined to be a false coin by the coin identification sensor 32 is discharged and returned to the tray 27 through the coin output port 22. When a money input finishing command is given from the POS register device 1 thereafter, the coin reserved in the temporary reservation space 33*g* is conveyed by the sorting and conveying mechanism 34 to be stored in the coin storage space 33*a* or the like corresponding to the denomination.

Coin Output Operation

When a money output command is given from the POS register device 1, the output money sorting gate 36 is switched to the coin output port 22 side, and the output money conveying mechanism 35 is driven forward. Thereafter, when a coin corresponding to a desired amount is sent out to the output money conveying mechanism 35 by the coin storage space 33*a* or the like, the coin is conveyed to the coin output port 22, and discharged and output to the tray 27 through the coin output port 22.

Coin Replenishment Operation

When a replenishment command is given, the output money sorting gate 36 is switched to the temporary reservation space 33*g* side, the output money conveying mechanism 35 is driven forward, and the sorting and conveying mechanism 34 is driven backward. The coin replenishing part 51 is then driven forward to supply the coin in the coin replenishing part 51 to the output money conveying mechanism 35. Accordingly, the coin supplied to the output money conveying mechanism 35 is conveyed to the temporary reservation space 33*g*, and stored in the coin storage space 33*a* or the like by the sorting and conveying mechanism 34 thereafter.

Coin Collection Operation

When a collection command is given, the output money conveying mechanism 35 is driven backward, and the coin stored in the coin storage space 33*a* or the like is sent out to the output money conveying mechanism 35. Accordingly, the coin sent out to the output money conveying mechanism 35 is conveyed backward to be collected into the coin collection space 52.

Bill Input Operation

When a bill is input through the bill input port 24 by a transaction, the bill input port 24 temporarily reserves a deposit from a customer. The bill that is temporarily reserved as described above is conveyed to the bill conveying mechanism 41 after the money input permission command is received from the POS register device 1. The bill discrimination sensor 42 determines whether the bill conveyed by the bill conveying mechanism 41 is true or false, and determines the denomination thereof. The bill that is determined to be a true bill by the bill discrimination sensor 42 is reserved in the temporary reservation space 44 that is dividedly configured on the upstream side portion of the one-thousand-yen bill storage space 43*b* or the mixed bills storage space 43*c* in the bill storage space 43 depending on the denomination. On the other hand, the bill that is determined to be a false bill by the bill discrimination sensor 42 is discharged and returned through the bill output port 25. Thereafter, when the money input finishing command is given from the POS register device 1, the bill reserved in the temporary reservation space 44 is stored in the one-thousand-yen bill storage space 43*b* or the mixed bills storage space 43*c*.

Bill Output Operation

When the money output command is given from the POS register device 1, a bill corresponding to a desired amount is sent out from each bill storage space 43 to the bill conveying mechanism 41, and the bill is conveyed to the bill output port 25 to be output through the bill output port 25.

Bill Replenishment Operation

When the replenishment command is given, the bill conveying mechanism 41 is driven forward, and the bill is sent out from the replenishment and collection space 61 to the bill conveying mechanism 41. The bill that is sent out from the replenishment and collection space 61 to the bill conveying mechanism 41 as described above is temporarily conveyed to the inspection space 43*a*. After all replenishment bills are conveyed to the inspection space 43*a*, the bill conveying mechanism 41 is driven backward, and the bill is sent out from the inspection space 43*a* to the bill conveying mechanism 41. Accordingly, the denomination of the bill sent out to the bill conveying mechanism 41 is discriminated by a bill discriminating unit 45 in the middle of the bill conveying mechanism 41, and the bill is conveyed to each bill storage space 43 (the one-thousand-yen bill storage space 43*b* and the mixed bills storage space 43*c*) to be stored therein.

Bill Collection Operation

When a collection command is given for the bills stored in the inspection space 43*a*, the bill conveying mechanism 41 is driven backward, and the bill stored in the inspection space 43*a* is sent out to the bill conveying mechanism 41. Accordingly, the bill sent out to the bill conveying mechanism 41 is conveyed backward to be collected in the replenishment and collection space 61.

On the other hand, when a collection command is given for the bills stored in the one-thousand-yen bill storage space 43*b* or the mixed bills storage space 43*c*, the bill conveying mechanism 41 is driven forward, and the bill stored in the bill storage space 43*b* or the like is sent out to the bill conveying mechanism 41. Accordingly, the bill sent out to the bill conveying mechanism 41 is conveyed forward to be stored in the inspection space 43*a*. In this way, after all bills as collection targets are stored in the inspection space 43*a*, the bill conveying mechanism 41 is driven backward, and the bill stored in the inspection space 43*a* is sent out to the bill conveying mechanism 41. Accordingly, the bill sent out to the bill conveying mechanism 41 is conveyed backward to be collected into the replenishment and collection space 61.

Figure 5:
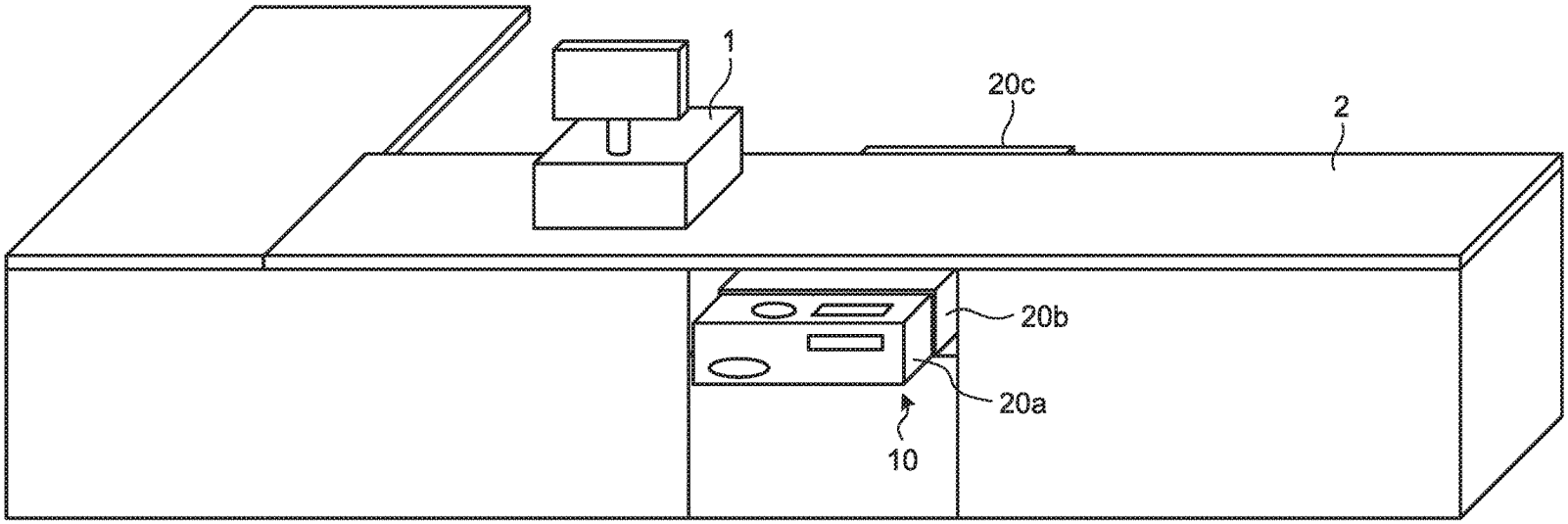
FIG. 5 is an explanatory diagram illustrating an application example of the money processing device illustrated in FIGS. 1 to 4.

In the money processing device 10 according to the first embodiment described above, the replenishing and collecting unit 20*c* is arranged on the rear side of the money processing unit 20*b* in a detachable manner, so that, when the operation unit 20*a* is installed facing a customer side in a register table 2 as illustrated in FIG. 5, the replenishing and collecting unit 20*c* is installed on the opposite side of the customer side.

With the money processing device 10 as described above, in performing money replenishing work, money collecting work, or maintenance work such as releasing jamming of money, the replenishing and collecting unit 20*c* may be detached from the money processing unit 20*b*. Thus, when the money processing device 10 is applied to the self-checkout machine, the semi-self-checkout machine, and the like, safety of work such as collecting work and maintenance work can be improved.

Second Embodiment

Figure 6:
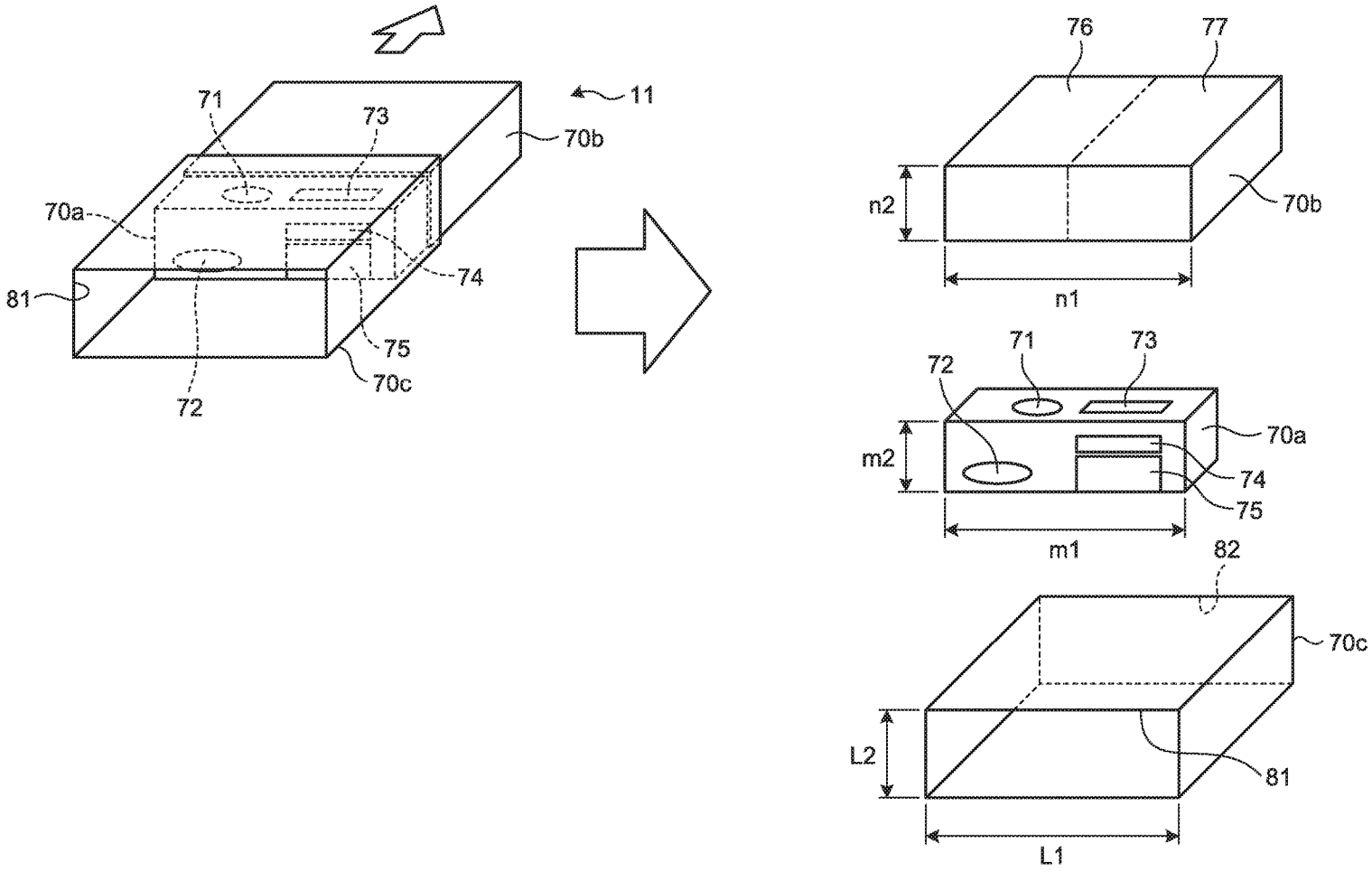
FIG. 6 is an explanatory diagram schematically illustrating a money processing device according to a second embodiment of the disclosure.

FIG. 6 is an explanatory diagram schematically illustrating a money processing device according to a second embodiment of the disclosure. A money processing device 11 exemplified herein configures a register system together with the POS register device 1 similarly to the money processing device 10 according to the first embodiment.

The money processing device 11 includes an operation unit 70*a*, a money processing unit 70*b*, and a main body 70*c*.

The operation unit 70*a* configures a front portion of the money processing device 11, and includes a coin input port 71, a coin output port 72, a bill input port 73, a bill output port 74, and a bill collection space 75.

The coin input port 71 is an opening through which a coin is input. The coin output port 72 is an opening through which a coin is discharged. The bill input port 73 is an opening through which a bill is input. The bill output port 74 is an opening through which a bill is discharged to the outside. The bill collection space 75 is a space for storing a bill that is collected when a collection command is given, and has a configuration that enables the bill collection space 75 to be pulled out toward the front.

The money processing unit 70*b* is arranged on the rear side of the operation unit 70*a*, and is known in the related art. The money processing unit 70*b* includes a coin processing unit 76 and a bill processing unit 77.

The coin processing unit 76 takes in the coin input through the coin input port 71 so as to sort the input coin and store the sorted coin in the coin storage space, and conveys a coin corresponding to change from the coin storage space to the operation unit 70*a* so as to output the corresponding coin through the coin output port 72 when a money output instruction is given.

The bill processing unit 77 takes in the bill input through the bill input port 73 so as to sort the input bill and store the sorted bill in the bill storage space 43, and conveys a bill corresponding to change from the bill storage space 43 to the operation unit 70*a* so as to output the corresponding bill through the bill output port 74 when the money output instruction is given.

The main body 70*c* is a housing having a rectangular parallelepiped shape where a front surface and a rear surface are opened. A width L1 of a front surface opening 81 and a rear surface opening 82 of the main body 70*c* is larger than a width m1 of the operation unit 70*a* and a width n1 of the money processing unit 70*b*, and a height L2 of the front surface opening 81 and the rear surface opening 82 is larger than a height m2 of the operation unit 70*a* and a height n2 of the money processing unit 70*b*.

Figure 7:
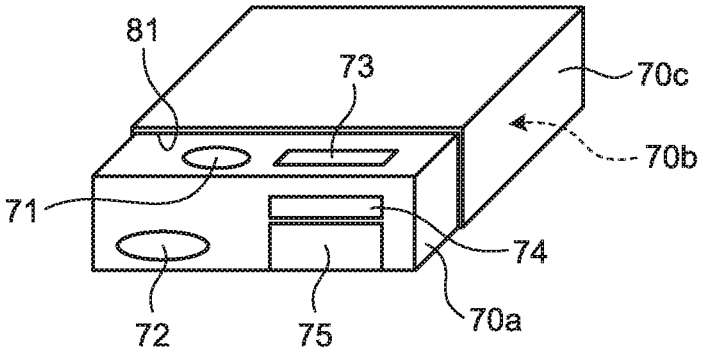
FIG. 7 is a perspective view illustrating a normal state of the money processing device illustrated in FIG. 6.

As illustrated in FIG. 7, the main body 70*c* houses the money processing unit 70*b* therein in a state in which the operation unit 70*a* is exposed from the front surface opening 81. A regulation part (not illustrated) is arranged in the main body 70*c*. The regulation part regulates the operation unit 70*a* not to be further pulled out toward the front from the state being exposed from the front surface opening 81.

Accordingly, the main body 70*c* allows the money processing unit 70*b* to be pulled out to the outside only through the rear surface opening 82.

Figure 8:
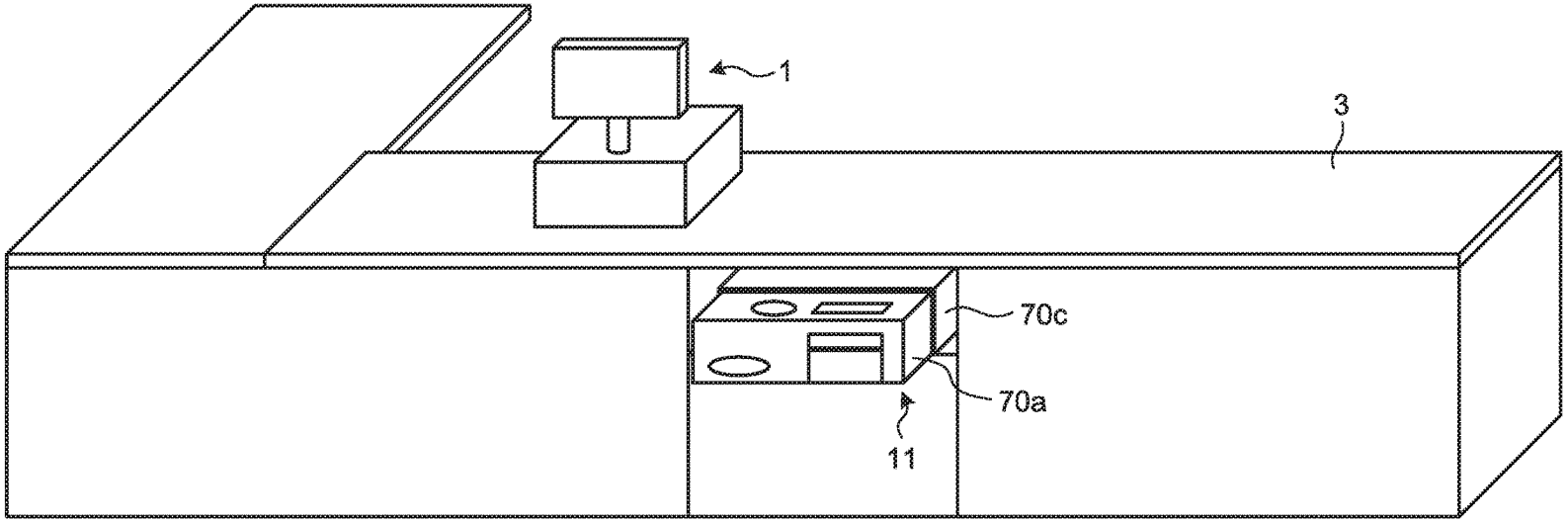
FIG. 8 is an explanatory diagram illustrating an application example of the money processing device illustrated in FIGS. 6 and 7.
Figure 9:
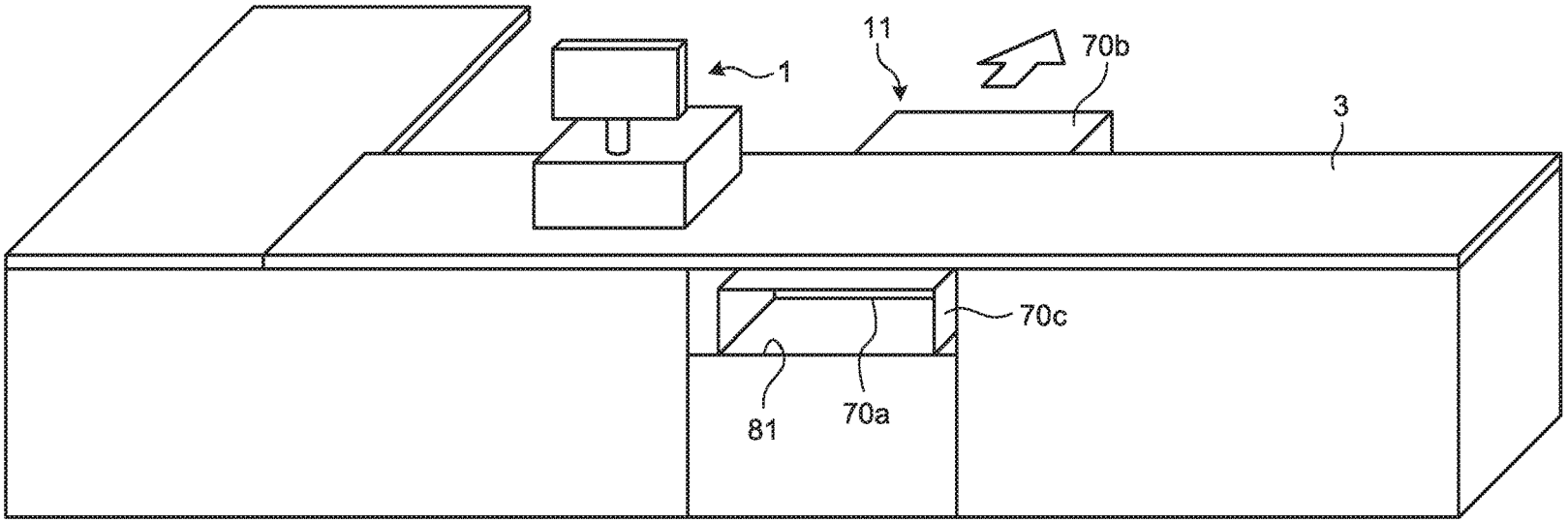
FIG. 9 is an explanatory diagram illustrating a case in which a money processing unit of the money processing device illustrated in FIG. 8 is pulled out toward the rear side.
Figure 10:
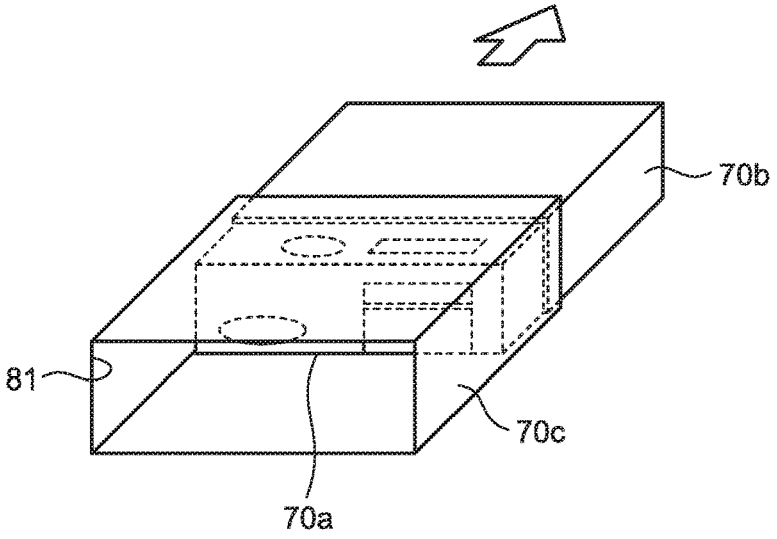
FIG. 10 is a perspective view illustrating a case in which a money processing unit of the money processing device illustrated in FIG. 7 is pulled out toward the rear side.

With the money processing device 11 according to the second embodiment described above, as illustrated in FIG. 8, when a worker performs money replenishing work, money collecting work, or maintenance work such as releasing jamming of money in the money processing unit 70*b* in a case where the operation unit 70*a* is installed facing a customer side in a register table 3, the money processing unit 70*b* may be pulled out toward the opposite side of the customer side (rear side) together with the operation unit 70*a* and the money processing unit 70*b* may be exposed from the rear surface opening 82 of the main body 70*c* as illustrated in FIGS. 9 and 10. This configuration can lower the possibility of money being seen by the customer during the work. Thus, when the money processing device 11 is applied to the self-checkout machine, the semi-self-checkout machine, and the like, safety of work such as collecting work and maintenance work can be improved.

The preferred first and second embodiments have been described above. However, the disclosure is not limited thereto, and can be variously modified.

In the first embodiment described above, the replenishing and collecting unit 20*c* is configured to be detachable from the money processing unit 70*b*. Alternatively, according to the disclosure, the replenishing and collecting unit may incorporate a memory that can store a replenished denomination, the number of replenished coins or bills, a collected denomination, the number of collected coins or bills, and the like. Due to this, money replenishing work and money collecting work can be performed in a state in which money is stored in the replenishing and collecting unit 20*c*, and money is not exposed during work such as collecting work and maintenance work, so that safety of the work can be improved.

In the first embodiment described above, the replenishing and collecting unit 20*c* (the coin replenishing and collecting unit 50 and the bill replenishing and collecting unit 60) are arranged on the money processing unit 20*b* (the coin processing unit 30 and the bill processing unit 40) in a detachable manner. Alternatively, according to the disclosure, the replenishing and collecting unit may be fixed to the money processing unit. Also in such a case, coins and bills can be replenished or collected on the opposite side of the customer side by opening and closing the door body, so that safety of work such as collecting work and maintenance work can be improved. According to the description of the first embodiment described above, the door body is individually arranged on each of the coin replenishing and collecting unit and the bill replenishing and collecting unit. Alternatively, according to the disclosure, the door body may be shared by the coin replenishing and collecting unit and the bill replenishing and collecting unit, and may be locked with a key lock, an electronic lock, and the like.

Figure 11:
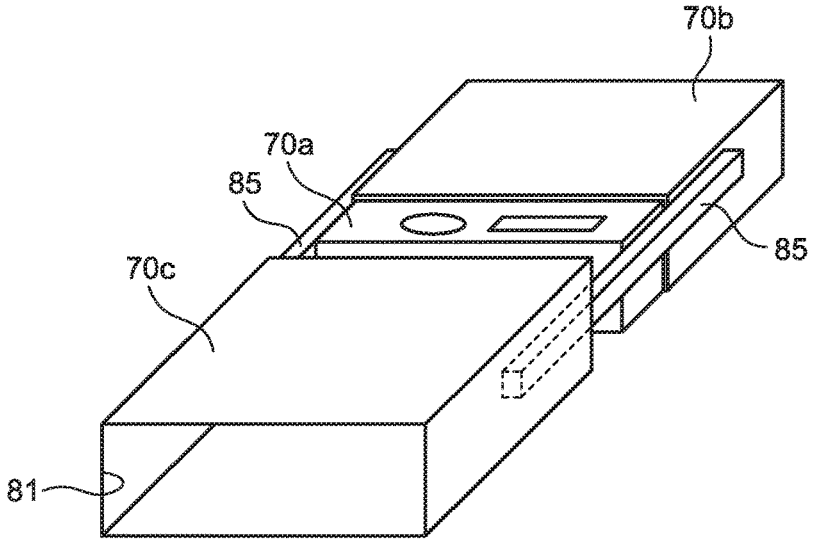
FIG. 11 is a perspective view illustrating a modification of the money processing device illustrated in FIGS. 6 and 7.

In the second embodiment described above, the money processing unit 70*b* is pulled out toward the opposite side of the customer side together with the operation unit 70*a*, and only the money processing unit 70*b* is exposed to the outside. Alternatively, according to the disclosure, the money processing unit 70*b* may be arranged so as to move toward and apart from the main body 70*c* with a rail mechanism 85 in a slidable manner as illustrated in FIG. 11, and when the money processing unit 70*b* is slid toward the rear side, the money processing unit 70*b* may be exposed to the outside together with the operation unit 70*a*.

In the second embodiment described above, the money processing unit 70*b* is pulled out toward the opposite side of the customer side together with the operation unit 70*a* to be exposed to the outside. Alternatively, according to the disclosure, the money processing unit may include a covering member for covering the money processing unit that is pulled out from the main body to the outside.

In the second embodiment described above, the width dimension and the height dimension of the operation unit 70*a* are smaller than the width dimension and the height dimension of the openings of the front surface and the rear surface of the main body 70*c*. Alternatively, according to the disclosure, the height dimension and the width dimension of the operation unit in a normal state may be configured to be larger than the width dimension and the height dimension of the front surface opening of the main body, and configured to be foldable such that the width dimension and the height dimension can be varied to be smaller than the width dimension and the height dimension of the front surface opening when the money processing unit is pulled out toward the rear side.

According to some embodiments, the replenishing and collecting unit is arranged at the rear of the money processing unit, the replenishing and collecting unit replenishing money of the money processing unit and collecting money stored in the storage space into a collection space when a collection command is given. Accordingly, when the self-checkout machine or the semi-self-checkout machine are configured with the operation unit facing a customer, a worker such as a salesperson can perform money replenishing work, money collecting work, or maintenance work such as releasing jamming of money without moving to the customer side. Thus, when the money processing device is applied to the self-checkout machine, the semi-self-checkout machine, and the like, safety of work such as collecting work and maintenance work can be improved.

According to some embodiments, when a pull-out operation is performed on the money processing unit, the main body allows the money processing unit to be pulled out only through the opening on the rear surface. Thus, in a case where the self-checkout machine or the semi-self-checkout machine is configured with the operation unit facing a customer, the money processing unit may be pulled out toward the opposite side of the customer side (rear side) to cause the money processing unit to be exposed through the opening on the rear surface of the main body when a worker performs money replenishing work, money collecting work, or maintenance work such as releasing jamming of money in the money processing unit. This configuration can lower the possibility of money being seen by the customer during the work. Thus, when the money processing device is applied to the self-checkout machine, the semi-self-checkout machine, and the like, safety of work such as collecting work and maintenance work can be improved.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A money processing device comprising:

an operation unit including a money input port through which money is input and a money output port through which money is discharged, and serving as a part for giving and receiving money;

a money processing unit provided on a rear side of the operation unit, and configured to: take in money input through the money input port so as to sort the input money and store the sorted money in a storage space; and convey money corresponding to change from the storage space to the operation unit so as to output the corresponding money through the money output port when a money output instruction is given, said money processing unit including a coin processing unit and a bill processing unit, the coin processing unit including a coin identification sensor identifying coins input to the money processing unit, a coin storage space having a plurality of coin spaces and a temporary coin reservation space to which the coins supplied from the coin identification sensor is stored, a sorting and conveying mechanism conveying the coins reserved in the temporary coin reservation space to the plurality of coin spaces, a coin collection space at a rear side of the coin processing unit, and an input money conveying mechanism conveying the coin from the coin spaces to the coin collection space or the money output port, the bill processing unit including an inspecting space identifying bills input to the money processing unit, a temporary bill storage space storing the bills supplied from the bill inspecting space, a mixed bill storage space storing mixed bills, a bill collecting space at a rear side of the bill processing unit, and a bill conveying mechanism conveying the inspecting space, the temporary bill storage and the bill collecting space; and a replenishing and collecting unit provided on the rear side of the coin processing unit and the bill processing unit, and configured to: replenish money of the coin processing unit and the bill processing unit; and collect the coins from the coin collection space and the bill collecting space when a collection command is given.

2. The money processing device according to claim 1, wherein the replenishing and collecting unit is provided at the money processing unit in a detachable manner.

3. The money processing device according to claim 1, further comprising:

a main body having a rectangular parallelepiped shape where each of front and rear surfaces has an opening, the main body being configured to house the money processing unit therein, wherein, when a pull-out operation is performed on the money processing unit, the main body is configured to allow the money processing unit to be pulled out only through the opening of the rear surface.

4. The money processing device according to claim 3, wherein, when the pull-out operation is performed on the money processing unit, the main body is configured to cause the money processing unit to be in a state of being pulled out to an outside of the main body.

5. The money processing device according to claim 3, wherein, when the pull-out operation is performed on the money processing unit, the main body is configured to cause the money processing unit and the operation unit to be in a state of being pulled out to an outside of the main body.

6. The money processing device according to claim 1, wherein the sorting and conveying mechanism is located at one side of the coin collection space, and the input money conveying mechanism is located at another side, of the coin collection space, opposite to the one side.

7. The money processing device according to claim 6, wherein the bill processing unit further includes a bill discriminating unit located in a middle of the bill conveying mechanism to discriminate the bill passing therethrough.

* * * * *